US008314319B2

(12) United States Patent
Yokoyama et al.

(10) Patent No.: US 8,314,319 B2
(45) Date of Patent: Nov. 20, 2012

(54) STORAGE SYSTEM AND STORAGE DEVICE OF MUSIC FILES

(75) Inventors: Taro Yokoyama, Yokohama (JP); Haruki Uehara, Hamamatsu (JP); Yoshiki Kasahara, Hamamatsu (JP); Yutaka Hasegawa, Hamamatsu (JP)

(73) Assignee: Yamaha Corporation (JP)

( * ) Notice: Subject to any disclaimer, the term of this patent is extended or adjusted under 35 U.S.C. 154(b) by 84 days.

(21) Appl. No.: 12/876,646

(22) Filed: Sep. 7, 2010

(65) Prior Publication Data

US 2011/0061514 A1 Mar. 17, 2011

(30) Foreign Application Priority Data

Sep. 14, 2009 (JP) ..... 2009-211623

(51) Int. Cl.
*G10H 1/00* (2006.01)
*G10H 7/00* (2006.01)

(52) U.S. Cl. ..... 84/602; 84/601; 84/609; 84/649

(58) Field of Classification Search ..... None
See application file for complete search history.

(56) References Cited

U.S. PATENT DOCUMENTS 5,763,805 A * 6/1998 Yamabata et al. ..... 84/645
5,808,223 A * 9/1998 Kurakake et al. ..... 84/609
6,426,455 B2 * 7/2002 Hasegawa ..... 84/470 R
7,129,408 B2 * 10/2006 Uehara ..... 84/645
2002/0002896 A1 * 1/2002 Hasegawa ..... 84/609
2006/0123976 A1 * 6/2006 Both et al. ..... 84/600
2009/0044685 A1 * 2/2009 Usa et al. ..... 84/600
2011/0146476 A1 * 6/2011 Zimmerman ..... 84/470 R

FOREIGN PATENT DOCUMENTS

JP 2007-133278 A 5/2007
JP 2008-233574 A 10/2008

* cited by examiner

*Primary Examiner* — Marlo Fletcher
(74) *Attorney, Agent, or Firm* — Rossi, Kimms & McDowell LLP

(57) ABSTRACT

A plurality of musical instrument is connected to a server device through a network to form a storage system. The musical instrument generates performance data, and sends the performance data to the server device every time the performance data is generated. The server device receives the performance data sent from the musical instrument. The server device has a clock unit that measures date and time, and a storage unit that stores the performance data received by the receiving unit. Further, a file generation unit of the server device divides a polarity of the performance data stored in the storage unit into blocks based on the date and time of the performance data measured by the clock unit when the performance data is received by the receiving unit, and generates performance files corresponding to the blocks of the performance data.

13 Claims, 6 Drawing Sheets

| PERFORMANCE FILE IDENTIFIER | TERMINAL IDENTIFIER | PERFORMANCE START DATE AND TIME | PERFORMANCE END DATE AND TIME |
|---|---|---|---|
| F0001 | 0001 | 2009-08-31T13 : 05 : 05 | 2009-08-31T13 : 07 : 10 |

FIG.9

| PERFORMANCE FILE IDENTIFIER | TERMINAL IDENTIFIER | PERFORMANCE START DATE AND TIME | PERFORMANCE END DATE AND TIME |
|---|---|---|---|
| F0001 | 0001 | 2009-08-31T13 : 05 : 05 | 2009-08-31T13 : 07 : 10 |
| F0002 | 0001 | 2009-08-31T14 : 10 : 45 | 2009-08-31T14 : 15 : 20 |
| F0003 | 0002 | 2009-09-01T09 : 35 : 25 | 2009-09-01T09 : 38 : 52 |
| F0004 | 0002 | 2009-09-01T10 : 46 : 13 | 2009-09-01T10 : 49 : 36 |
| F0005 | 0001 | 2009-09-01T11 : 27 : 33 | 2009-09-01T11 : 32 : 41 |

SELECT A FILE TO PERFOTM

STORAGE SYSTEM AND STORAGE DEVICE OF MUSIC FILES

BACKGROUND OF THE INVENTION

1. Technical Field

The present invention relates to technology for storing information that expresses a music performance performed using a musical instrument.

2. Background Art

A system that stores performance data, which expresses a music performance that was performed using a musical instrument, on a server computer via a communication network is disclosed in Japanese published unexamined patent application No. 2007-133278. In this system, after operation for starting a performance is commenced using an electronic musical instrument, a performer performs a performance, and the stored performance data is sent to a server computer that is connected to a communication network. After receiving the performance data, the server computer stores the received performance data. In the system disclosed in Japanese published unexamined patent application No. 2007-133278, the performance data is not sent after the performance ends, but rather performance data can be sent each time operation is performed on a musical keyboard or a pedal and stored on a server computer. In addition, in the system disclosed in Japanese published unexamined patent application No. 2007-133278, it is possible to download performance data that has been stored on a server computer and listen to a past performance.

In the system disclosed in Japanese published unexamined patent application No. 2007-133278, when storing performance data on a server computer, it is necessary for the performer to perform an operation to start the performance and an operation to end the performance using an electronic musical instrument. However, performing an operation to start a performance and an operation to end a performance each time a performance is performed is troublesome for the performer. Moreover, in the case that a performer forgets to perform the operation to start the performance, the performance data is not stored and the performance cannot be reproduced, and in the case that the performer forgets to perform the operation to end a performance, a problem occurs in that performance data continues to be stored.

SUMMARY OF THE INVENTION

Taking into consideration the background described above, the object of the present invention is to provide a technique of storing information that expresses a music performance without the performer having to perform an operation for starting storage and ending storage of the performance for each performance.

The present invention provides a storage system comprising: a plurality of musical instruments capable of sending information; and a storage device capable of communicating with the plurality of the musical instruments and storing information sent from the musical instruments, wherein the musical instrument comprises: a performance information generation unit that generates performance information of the musical instrument; a first clock unit that measures date and time; and a transmission unit that sends performance data to the storage device when the performance information is generated by the performance information generation unit, the performance data being a set of the performance information generated by the performance information generation unit and performance date and time information that indicates performance date and time measured by the first clock unit when the performance information is generated by the performance information generation unit, and wherein the storage device comprises: a receiving unit that receives the performance data sent from the transmission unit of the musical instrument; a second clock unit that measures date and time; a storage unit that stores the performance data received by the receiving unit; and a file generation unit that divides a plurality of the performance data stored in the storage unit into blocks based on the performance date and time information included in the performance data received by the receiving unit, or based on acquisition date and time of the performance data measured by the second clock unit when the performance data is received by the receiving unit, and that generates performance files corresponding to the blocks of the performance data.

In the present invention, the file generation unit divides the plurality of the performance data into blocks when a time interval on the time line of the performance date and time of the performance date and time information that is included in the plurality of the performance data received by the receiving unit is a specified value or greater, or when a time interval on the time line of the acquisition date and time at which the plurality of the performance data are received by the receiving unit is a specified value or greater.

In a preferred from, the receiving unit receives the performance data containing a terminal identifier identifying the musical instrument that transmits the performance data, the storage unit stores the performance data received by the receiving unit together with the terminal identifier identifying the musical instrument that transmits the performance data and the acquisition date and time of the performance data measured by the second clock unit when the performance data is received by the receiving unit, and the file generation unit divides the plurality of the performance data stored in the storage unit into blocks based on the terminal identifier such that each block contains the performance data sent by the same musical instrument, and based on the acquisition date and time of the performance data measured by the second clock unit, when a difference between a current date and time measured by the second clock unit and a recent one of the acquisition time and date of the performance data is greater than a predetermined time length.

In one form, the file generation unit generates the performance file containing log information which records addresses of the performance data at which the performance data of the corresponding block are stored in the storage unit, sequentially in the order of each performance date and time contained in each performance data.

In another from, the file generation unit generates the performance file containing log information which records each performance date and time contained in each performance data of the corresponding block, sequentially from early performance date and time to late performance date and time.

In a preferred form, the transmission unit successively accumulates the performance data, and transmits the accumulated performance data when a predetermined time length lapses from a time at which previously accumulated performance data have been transmitted to the storage device.

In alternative form, the transmission unit successively accumulates the performance data, and transmits the accumulated performance data each time a total amount of the accumulated performance data exceeds a predetermined amount.

In a preferred form, the storage device further comprises a table generation unit that generates a performance table of the performance files generated by the file generation unit, such that the performance table contains a file identifier identifying a performance file generated by the file generation unit, a terminal identifier identifying the musical instrument that transmits a plurality of performance data contained in the performance file or a user identifier identifying a user of the musical instrument that transmits a plurality of performance data contained in the performance file, a start date and time indicting a start date and time at which a plurality of performance data of the performance file starts, and an end date and time indicting an end date and time at which a plurality of performance data of the performance file ends.

The musical instrument further comprises: a table acquiring unit that acquires the performance table from the storage device; a display unit that displays the performance table for selection of a desired performance file listed in the performance table; and a requesting unit that requests downloading of the selected performance file from the storage device for reproduction of the performance information contained in the selected performance file.

Expediently, the table generation unit analyzes the plurality of the performance data contained in the performance file so as to determine a title of a piece of music represented by the plurality of the performance data or so as to obtain a musical attribute of a piece of music represented by the plurality of the performance data, and adds the determined title or obtained musical attribute into the performance table.

In a practical form, the musical instrument is played by a user to perform pieces of music so that the performance information generation unit generates the performance information during the course of performing the pieces of music and the transmission unit sends the plurality of the performance data in response to the generation of the performance information, and wherein the file generation unit of the storage device divides the plurality of the performance data into blocks so that each block corresponds to each piece of music, whereby each performance file contains the plurality of the performance data representing each piece of music.

Practically, the file generation unit of the storage device divides the plurality of the performance data between a performance data belonging to a preceding piece of music and another performance data belonging to a succeeding piece of music.

The present invention further provides a storage device that communicates with a musical instrument having a performance information generation unit for generating performance information, a first clock unit for measuring date and time, and a transmission unit for sending a plurality of performance data, which is a set of the performance information generated by the performance information generation unit and performance date and time information that indicates performance date and time that is measured by the first clock unit when the performance information is generated by the performance information generation unit, the storage device comprising: a receiving unit that receives the performance data sent from the transmission unit of the musical instrument; a second clock unit that measures date and time; a storage unit that stores the performance data received by the receiving unit; and a file generation unit that divides a plurality of the performance data stored in the storage unit into blocks based on the performance date and time information included in the performance data received by the receiving unit, or based on acquisition date and time of the performance data measured by the second clock unit when the performance data is received by the receiving unit, and that generates performance files corresponding to the blocks of the performance data.

With the present invention, it is possible to store information that expresses apiece of music for each performance without the performer having to perform an operation to start memory storage and to end memory storage for a performance.

BRIEF DESCRIPTION OF THE DRAWINGS

FIG. 9 is a diagram of an example of a screen that is displayed on a display unit of the musical instrument.

DETAILED DESCRIPTION OF THE INVENTION

[Embodiment]

(Construction of the Embodiment)

Figure 1:
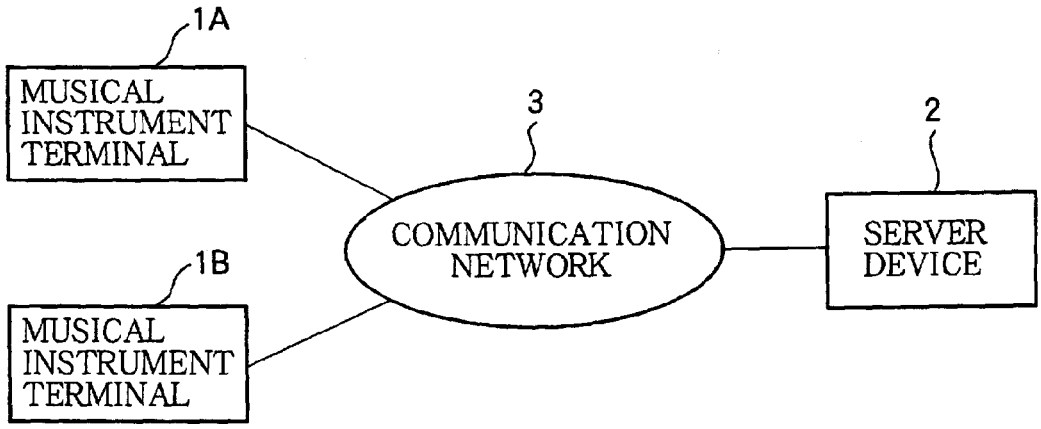
FIG. 1 is a diagram illustrating the overall construction of a system of one embodiment of the present invention.

FIG. 1 is a diagram that illustrates the overall construction of a system of one embodiment of the present invention. As illustrated in the figure, in this system, musical instrument terminals 1A, 1B and a server device 2 that functions as a storage device that stores data that is sent from the musical instrument terminals 1A, 1B are connected to a communication network 3 that connects computers together. A plurality of devices can be connected to the communication network 3, however, in FIG. 1, in order to simplify the explanation, two musical instrument terminals 1A, 1B and one server device 2 are illustrated.

(Construction of Musical Instrument Terminals 1A, 1B)

In this embodiment, musical instrument terminals 1A, 1B are electronic keyboards. In this embodiment, the hardware construction of the musical instrument terminals 1A, 1B is the same, so in the following explanation, where there is no need to distinguish between both, A, B of the reference code will be omitted.

Figure 2:
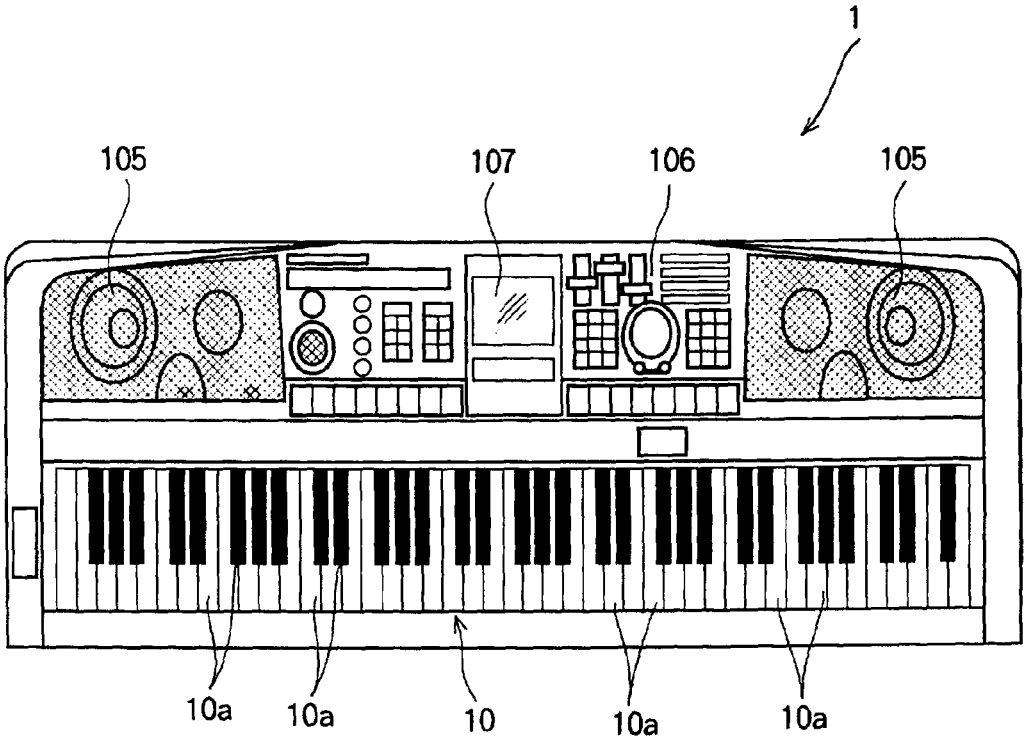
FIG. 2 is a diagram illustrating the external appearance of musical instrument terminals.
Figure 3:
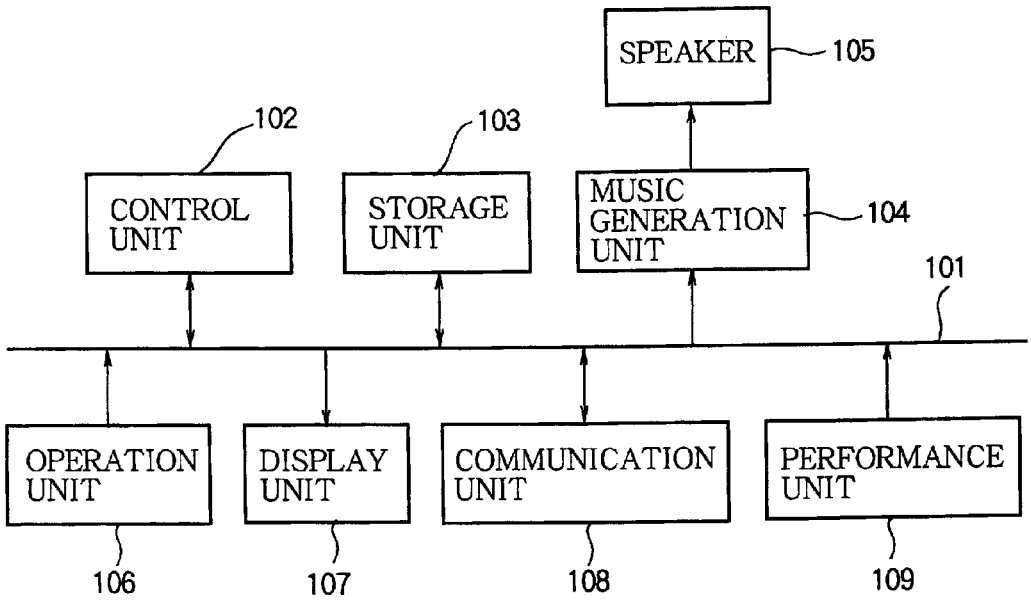
FIG. 3 is a block diagram illustrating the hardware construction of the musical instrument terminals.

FIG. 2 is a diagram that illustrates the external appearance of the musical instrument terminal 1, and FIG. 3 is a block that illustrates the hardware construction of the musical instrument terminal 1. As illustrated in FIG. 3, except for the speaker 105, all of the parts of the musical instrument terminal 1 are connected to a bus 101, and signals are exchanged among parts via this bus 101.

A performance unit 109 comprises a plurality of keys 10*a*. The performer using the musical instrument terminal 1 plays a musical performance by operating the keys 10*a* of the performance unit 109. When a performer operates the keys 10*a* and performs a performance, the performance unit 109 outputs a signal that corresponds to the operation performed using the keys 10*a*.

A storage unit 103 comprises a non-volatile memory, and stores a terminal identifier that uniquely identifies the musical instrument terminal 1 and data that is acquired from the server device 2. In this embodiment, the storage unit 103 of the musical instrument 1A stores "0001" as a terminal identifier, and the storage unit 103 of the musical instrument terminal 1B stores "0002" as a terminal identifier.

The control unit 102 is hardware that controls all of the parts that are connected to the bus 101 and comprises: a CPU (Central Processing Unit), ROM (Read Only Memory) that stores a program for controlling each of the parts of the musical instrument terminal 1, and RAM (Random Access Memory) that is used as a work area when executing the program. When the CPU of the control unit 102 executes the program stored in ROM, the control unit 102 controls each of the parts of the musical instrument terminal 1 via the bus 101, making it possible for the musical instrument terminal 1 to function as an electronic keyboard. In addition, when the program stored in ROM of the control unit 102 is executed, a function of generating MIDI (Musical Instrument Digital Interface; registered trademark) messages according to operation performed using the performance unit 109, and a function of measuring the date and time are obtained. Moreover, a function of sending performance data, which includes generated MIDI messages (performance information), performance date and time information that indicates the performance date and time, and the terminal identifier, to the server device 2, and a function of acquiring the performance data stored in the server device 2 and outputting music sound according to the acquired performance data are realized by the musical instrument terminal 1.

A communication unit 108 functions as an interface for performing communication via the communication network 3, and performs data communication with other devices according to control by the control unit 102. A display unit 107 comprises a liquid-crystal display panel, and displays various screens for operating the musical instrument terminal 1. An operation unit 106 comprises various buttons for operating the musical instrument terminal 1. By operating the buttons of the operation unit 106, the user inputs various instructions to the musical instrument terminal 1. A music generation unit 104 generates a signal for music indicated by a MIDI message, and supplies that generated signal to a speaker 105. When the signal supplied from the music generation unit 104 is input to the speaker 105, music is output from the speaker 105 according to the input signal.

(Construction of the Server Device 2)

Figure 4:
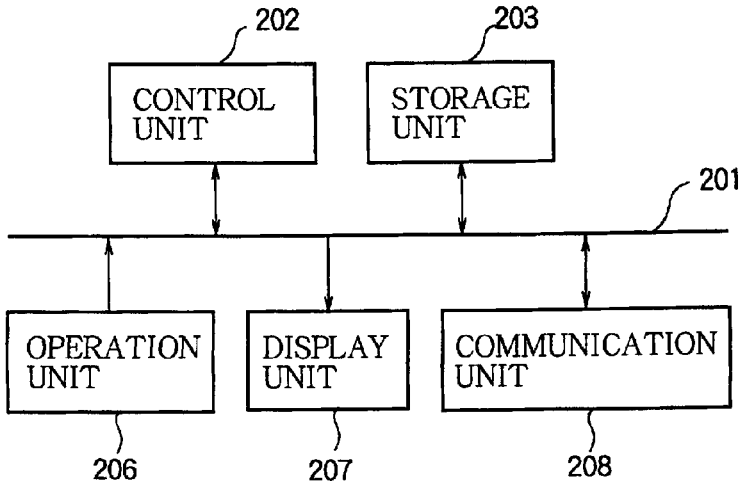
FIG. 4 is a block diagram of the hardware construction of a server device.

FIG. 4 is a block diagram illustrating the hardware construction of the server device 2. As illustrated in FIG. 4, all of the parts of the server device 2 are connected to a bus 201, and signals are exchanged among parts via this bus 201.

A control unit 202 is hardware for controlling each part that is connected to the bus 201, and comprises: a CPU, ROM for storing a program for controlling each part of the server device 2, and RAM. By reading and executing the program that is stored in ROM, the CPU of the control unit 202 controls each part of the server device 2 via the bus 201.

A communication unit 208 functions as an interface for performing communication via the communication network 3, and performs data communication with other devices according to control from the control unit 202. A display unit 207 comprises a liquid-crystal display panel, and displays various screens for operating the server device 2. An operation unit 206 comprises a keyboard and a mouse for operating the server device 2. By operating the keyboard and mouse of the operation unit 206, the user inputs various instructions to the server device 2.

A storage unit 203 comprises a hard disk device, and stores performance data that is sent from the musical instrument terminal 1, and a server program that makes it possible to realize the server function of a client server system. When the CPU of the control unit 202 executes the server program, the server device 2 realizes: a function of storing performance data that is sent from the musical instrument terminal in the storage unit 203, a function of sending the performance data stored in the storage unit 203 to the musical instrument terminal 1, and a function of keeping the date and time. The storage unit 203 has a buffer area for temporarily storing performance data, and a permanent memory for permanently storing performance data.

(Operation of the Embodiment)

(Operation when Storing Performance Data)

Next, the operation of the embodiment will be explained. In the explanation below, the explanation of the operation will be done in case that the user of the musical instrument terminal 1 plays pieces of music in succession.

Figure 5:
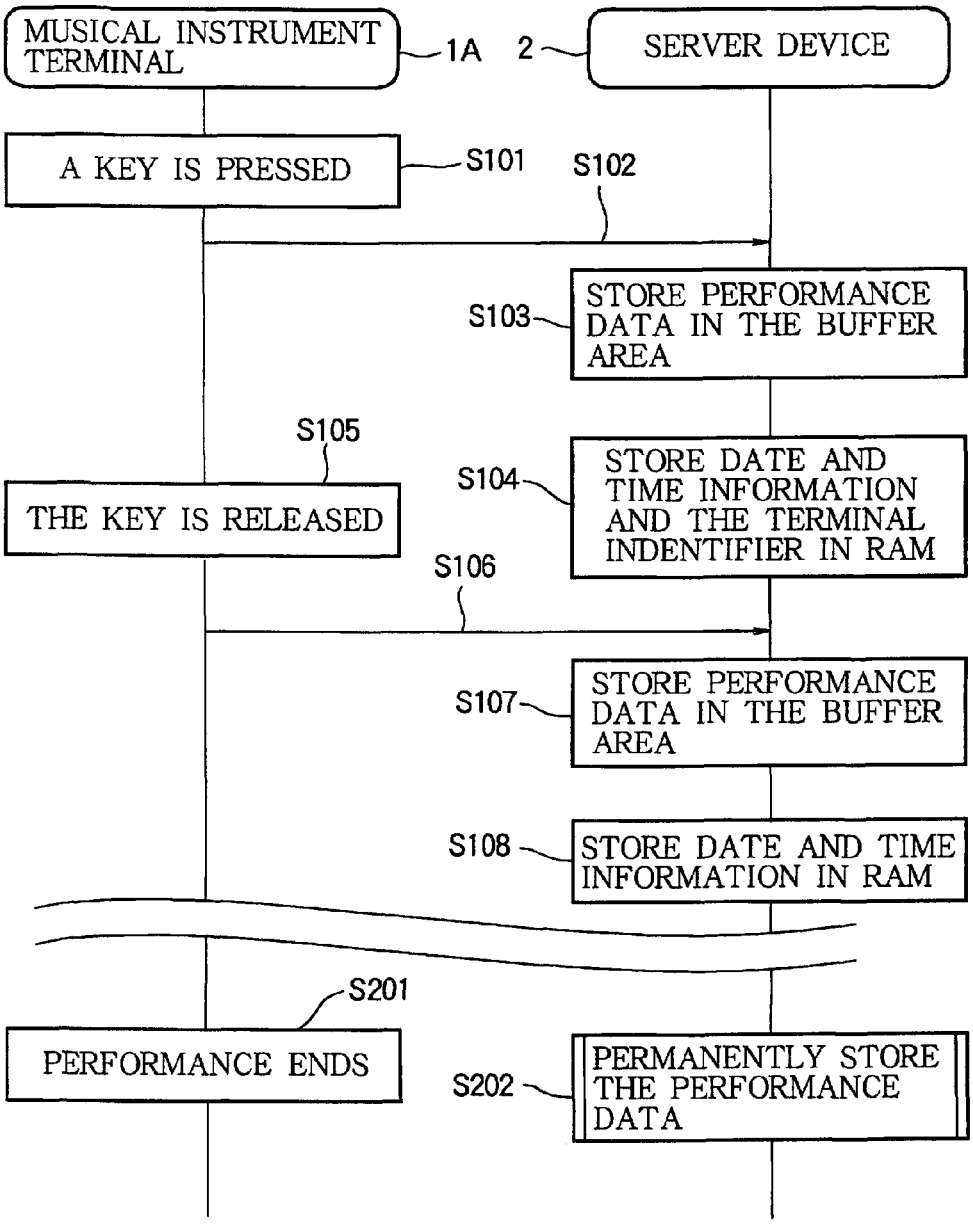
FIG. 5 is a diagram for explaining the operation of the embodiment.

First, when the user turns ON the power to the musical instrument terminal 1A, the control unit 102 executes the program that is stored in ROM of the control unit 102. By doing so, the musical instrument terminal 1A is able to perform the function of an electronic keyboard. Moreover, the musical instrument terminal 1A becomes able to communicate with the server device 2. Next, when the user presses keys 10*a* (FIG. 5: step S101), the control unit 102 generates a MIDI message that includes performance operation information such as a note-ON message, the note number that corresponds to the pressed key 10*a*, and velocity that corresponds to the operation of key 10*a*. In addition, the control unit 102 generates performance date and time information that indicates the performance date and time at which this note-ON MIDI message was generated. The control unit 102 generates performance data that includes the generated MIDI message, the performance date and time information, and the terminal identifier "0001" that is stored in the storage unit 103 (step S102). The control unit 102 also controls the communication unit 108 and sends the generated performance data to the server device 2. Furthermore, the control unit 102 sends the MIDI message to the music generation unit 104. After the MIDI message is supplied, the music generation unit 104 generates a music signal that corresponds to the note number and velocity specified in the MIDI message, and supplies that generated signal to the speaker 105. When the signal supplied from the music generation unit 104 is inputted to the speaker 105, the speaker 105 outputs music sound corresponding to the inputted signal.

When the communication unit 208 receives the performance data that is sent from the musical instrument terminal 1A, the control unit 202 stores the performance data that is received by the communication unit 208 in the buffer area of the storage unit 203 (step S103). In addition, the control unit 202 acquires the terminal identifier that is included in the received performance data. After acquiring the terminal identifier, the control unit 202 correlates the acquisition date and time information, which indicates the acquisition date and time at which this terminal identifier was acquired, with the terminal identifier and stores them in RAM.

Here, for example, when the date and time that is measured by the control unit 202 is "Aug. 31, 2009, 13:05.05", the control unit 202 stores the set of the acquisition date and time information that indicates this date and time, "2009-8-31T13:05:05", and the terminal identifier, "0001", in RAM (step S104).

Figures 6, 7:
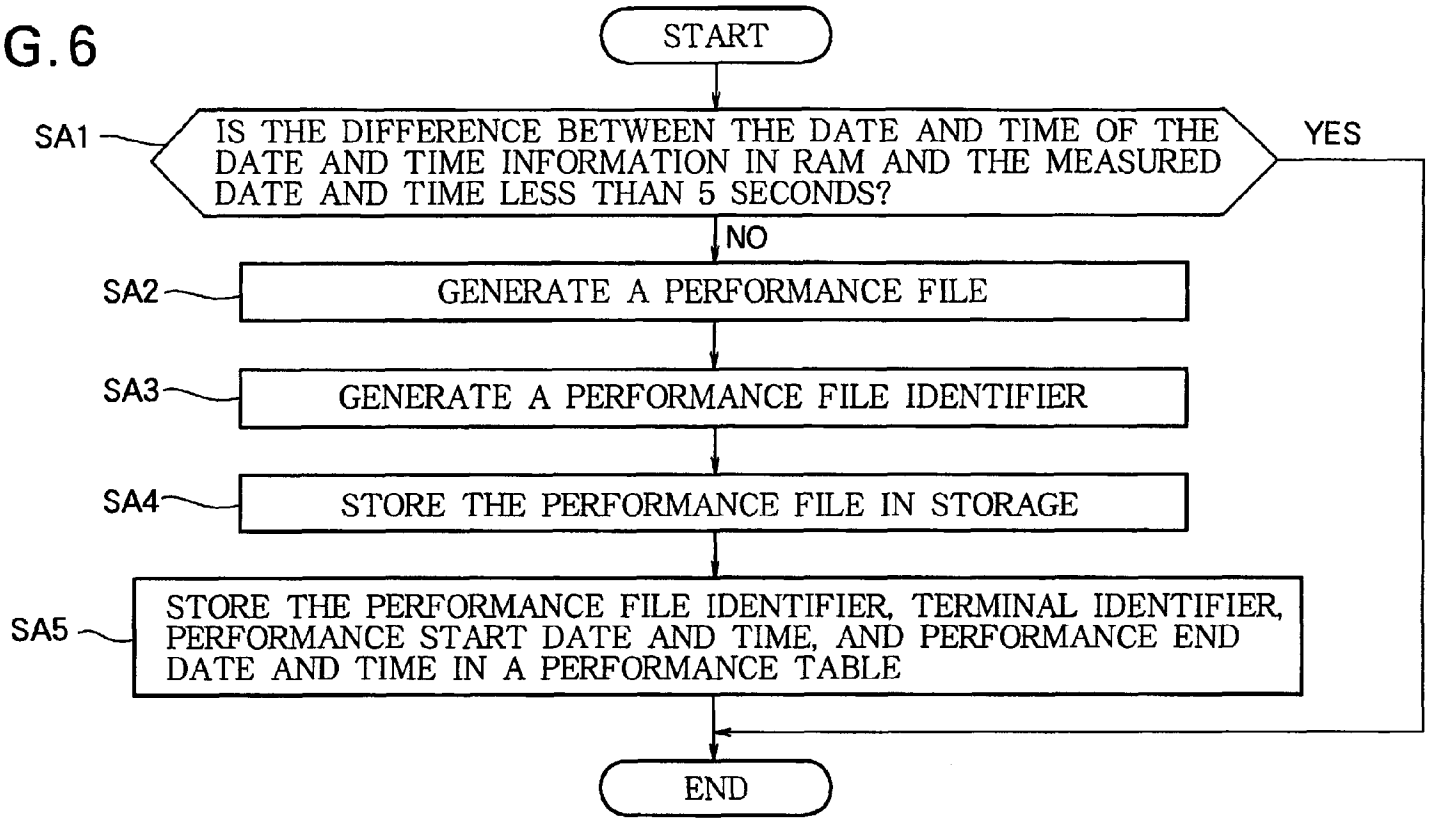
FIG. 6 is a flowchart that illustrates the flow of processing performed by the server device.
FIG. 7 is a diagram that illustrates the format of a performance table.

After the set of the terminal identifier and the acquisition date and time information have been stored in RAM, the control unit 202 executes the process illustrated in FIG. 6 at a preset fixed cycle (for example, once every second in this embodiment). This cycle is not limited to one second, and could be a cycle other than one second. The control unit 202 determines the difference between the measured date and time and the acquisition date and time information that is stored in RAM as a set with the terminal identifier. Here, when the difference in the date and time is less than a preset time (for example, 5 seconds in this embodiment), (FIG. 6; step SA1: YES), the control unit 202 ends the processing illustrated in FIG. 6. This preset time is not limited to 5 seconds, and could be a time other than 5 seconds.

Next, in the musical instrument terminal 1A, when the user's finger is removed from the pressed key 10*a* (step S105), the control unit 102 generates another MIDI message that includes performance operation information such as a note-OFF message, a note number that corresponds to the released key 10*a* and velocity that corresponds to the key 10*a* operation. In addition, the control unit 102 generates performance date and time information that indicates the date and time at which this note-OFF MIDI message was generated. The control unit 102 generates performance information that includes the generated MIDI message, performance date and time information and terminal identifier "0001" that is stored in the storage unit 103. In addition, the control unit 102 controls the communication unit 108 and sends the generated performance data to the server device 2 (step S106). Moreover, the control unit 102 sends the MIDI message to the music generation unit 104. After the note-OFF MIDI message has been supplied, the music generation unit 104 stops generating the music signal that corresponds to the note number specified by the MIDI message. By doing so, the music outputted from the speaker 105 is stopped.

After the communication unit 208 receives the performance data that was sent from the musical instrument terminal 1A, the control unit 202 stores the received performance data in the buffer area of the storage unit 203 (step S107). The control unit 202 also acquires the terminal identifier that is included in that received performance data. After acquiring the terminal identifier, the control unit 202 correlates the acquisition date and time information that indicates the acquisition date and time at which this terminal identifier was acquired with the terminal identifier and stores the result in RAM. When there is already a terminal identifier stored in RAM that is the same as the terminal identifier that is acquired here, the acquisition date and time information that is coupled with this terminal identifier is overwritten by the newly acquired acquisition date and time information (step S108).

Here, the acquired terminal identifier "0001" is already stored in RAM by the operation described above, so when the date and time measured by the control unit 202 is "Aug. 31, 2009, 13:05.06", the date and time information that indicates the date and time measured by the control unit 202 is overwritten as "2009-8-31T13:05:06". Next, the process illustrated in FIG. 6 is executed, and when the difference between the date and time measured by the control unit 202 and the data and time indicated by the acquisition date and time information that is stored in RAM as a set with the terminal identifier "0001" is less than a preset time, the control unit 202 ends the processing illustrated in FIG. 6.

After this, when a further performance is performed in which key 10*a* is pressed and released in the same way as described above, performance data that includes a note-ON MIDI message, and performance data that includes a note-OFF MIDI message are sent sequentially from the musical instrument terminal 1A using the same operation as described above to the sever device 2. In the server device 2, the performance data that was sent from the musical instrument terminal 1A is stored in the buffer area until NO is determined in step SA1.

Next, when the user ends a music performance (step S201), performance data is no longer sent from the musical instrument terminal 1A. When performance data is no longer sent from the musical instrument terminal 1A, the difference in the server device 2 between the measured date and time and the date and time that is coupled with the terminal identifier "0001" and stored in RAM becomes large. When the difference between the measured date and time (namely current date and time) and the date and time that is coupled with the terminal identifier "0001" and stored in RAM becomes 5 seconds or more (step SA1: NO), the control unit 202 determines that the performance by the musical instrument device 1A that is specified by the terminal identifier "0001" has ended.

After determining NO is step SA1, the control unit 202 performs a process of permanently storing the performance data that is stored in the buffer area (step S202).

More specifically, first the control unit 202 divides the sequence of the performance data by acquisition date and time at which the performance data was last received from the musical instrument terminal 1A. Here, the sequence of the performance data is divided into preceding performance data that was received before the acquisition date and time of the performance data last received from the musical instrument terminal 1A, and succeeding performance data that was received after the acquisition or reception date and time of the performance data last received from the musical instrument terminal 1A. The control unit 202 extracts all of the performance data that includes the terminal identifier "0001" that was stored in RAM from among the performance data that is divided out as performance data that was received before the date and time of the performance data that was last received from the music instrument terminal 1A, and generates a performance file that collects into one file all of the extracted performance data (step SA2). When dividing the performance data, the control unit 202 can also divide the performance data into performance data that includes the performance date and time information before the date and time of the performance date and time information that is included in the performance data last received from the musical instrument terminal 1A, and performance date and time information after the date and time of the performance date and time information that is included in the performance data last received from the musical instrument terminal 1A.

Namely, a file generation unit of the server device divides the sequence of the performance data into blocks when a time interval on the time line of the date and time of the date and time information that is included in the sequence of the performance data received by a receiving unit of the server device 2 is a specified value (e.g., 5 seconds) or greater, or when a time interval on the time line of the date and time at which the sequence of the performance data are received by the receiving unit is a specified value or greater.

Stated otherwise, the musical instrument 1 is played by a user to perform pieces of music so that the performance information generation unit 104 sequentially generates the performance information during the course of performing the pieces of music and the transmission unit 108 sends the sequence of the performance data in response to the generation of the performance information, and the file generation unit of the server device 2 divides the sequence of the performance data into blocks so that each block corresponds to each piece of music, whereby the each performance file contains the sequence of the performance data representing each piece of music. More specifically, the server device 2 divides the sequence of the performance data between a performance data belonging to a preceding piece of music and another performance data belonging to a succeeding piece of music.

Moreover, the control unit 202 generates a performance file identifier that uniquely identifies the performance file (step SA3), and stores the performance file including the performance file identifier in the permanent memory area of the storage unit 203 (step SA4).

Furthermore, the control unit 202 acquires the terminal identifier that is included in the performance data of the performance file, as well as the earliest performance date and time information (performance start date and time) and the latest performance date and time information (performance end date and time) from among the times included in the performance data in the performance file, then correlates the acquired terminal identifier, performance start date and time, performance end date and time and the generated file identifier, and stores the result in a performance table illustrated in FIG. 7 (step SA5).

As described above, the server device further includes a table generation unit that generates a performance table of the performance files generated by the file generation unit, such that the performance table contains a file identifier identifying a performance file generated by the file generation unit, a terminal identifier identifying the musical instrument that transmits a sequence of performance data contained in the performance file or a user identifier identifying a user of the musical instrument that transmits a sequence of performance data contained in the performance file, a start date and time indicting a start date and time at which a sequence of the performance data of the performance file starts, and an end date and time indicting an end date and time at which a sequence of the performance data of the performance file ends.

FIG. 7 is a diagram of an example of the format of a performance table that stores a set of the terminal identifier, performance start date and time, performance end date and time, and performance file identifier. The storage unit 203 stores this performance table. For example, when the earliest performance date and time information in the performance date and time information that is included in the performance data among the performance file is "2009-08-31T13:05:05", the performance date and time that is included in the performance data that was last sent from the musical instrument terminal 1A is "2009-08-31T13:07:10", the terminal identifier is "0001", and "F0001" is generated as the file identifier, this information is stored in the same row of the performance table as illustrated in FIG. 7.

In this way, when the user turns ON the power to the musical instrument terminal 1 and plays a music performance using the musical instrument terminal 1, a performance file that includes a MIDI message that expresses the performance that the user performed is stored in the server device 2 even though the user does not perform a button operation for starting recording of the performance and does not perform a button operation for ending recording. In addition, the operation described above is performed each time the user plays a performance, and a performance file is stored in the server device 2 each time the user plays a performance.

(Operation when the Musical Instrument Terminal Acquires Performance Data from the Server Device 2)

Next, the operation when the musical instrument terminal 1B acquires a performance file that is stored in the server device 2, and the operation when the musical instrument terminal 1B outputs music according to the acquired performance file will be explained.

Figure 8:
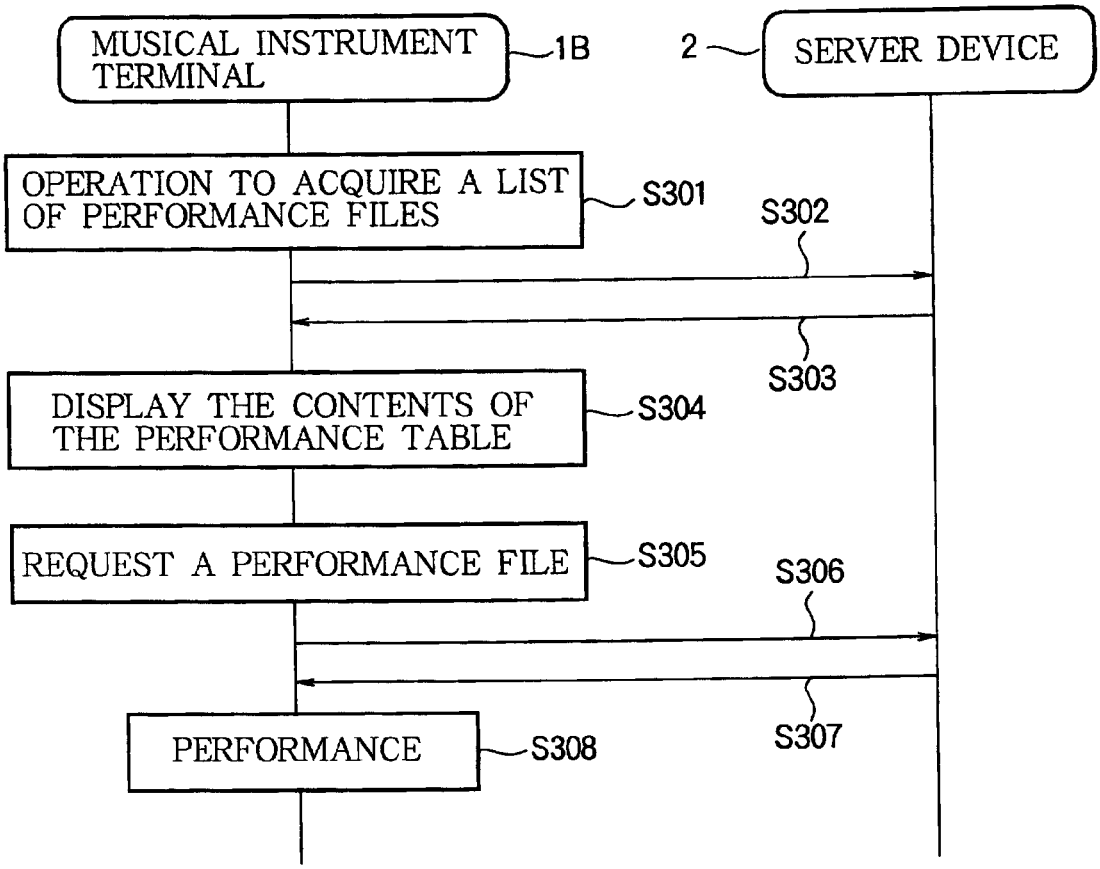
FIG. 8 is a diagram for explaining the operation of the embodiment.

First, when the user performs an operation on the operation unit 106 of the musical instrument terminal 1B to which the power has been turned ON indicating to acquire a list of performance files that are stored in the server device 2 (FIG. 8: step S301), a request message is sent from the musical instrument terminal 1B to the server device 2 requesting a list of performance files (step S302).

After this request message has been received by the server device 2, the control unit 202 sends the performance table that is stored in the storage unit 203 to the music instrument terminal 1B (step S303). After the communication unit 108 of the musical instrument terminal 1B receives the performance table that has been sent from the server device 2, the control unit 102 of the musical instrument terminal 1B displays the file identifier, the terminal identifier, the performance start date and time and the performance end date and time on the display unit 107 according to the contents of the performance table as illustrated in FIG. 9 (step S304).

Next, the user uses the operation unit 106 to perform an operation of selecting one of the displayed performance file identifiers, and when the user uses the operation unit 106 to perform an operation of requesting the performance file that is specified by the selected performance file identifier (step S305), a file request message that includes the selected performance file identifier and that requests the performance file is sent from the musical instrument terminal 1B to the server device 2 (step S306). For example, when the user uses the operation unit 106 to select the performance file identifier "F0001" and request the performance file that is specified by that performance file identifier, a file request message that includes this file identifier "F0001" is sent from the musical instrument terminal 1B to the server device 2.

After this file request message has been received by the server device 2, the control unit 202 searches the storage unit 203 for a performance file that includes the file identifier "F0001" that is included in the file request message. When a performance file that includes this file identifier is found, the server device 2 sends the found performance file to the musical instrument terminal 1B (step S307). After the performance file that is downloaded from the server device 2 is received by the musical instrument terminal 1B, the control unit 102 of the musical instrument terminal 1B reproduces the performance according to the performance data that is included in the performance file (step S308). The performance file that is specified by the file identifier "F0001" is a performance file that expresses a music performance that was performed on the musical instrument terminal 1A by the user of the musical instrument terminal 1A, so the musical instrument terminal 1B reproduces the performance that was performed on the other musical instrument terminal 1A.

Namely, the musical instrument includes a table acquiring unit that acquires the performance table from the storage device, a display unit that displays the performance table for selection of a desired performance file listed in the performance table, and a requesting unit that requests downloading of the selected performance file from the storage device for reproduction of the performance information contained in the selected performance file.

More specifically, the control unit 102 expands the performance data that was included in the performance file in RAM. Next, the control unit 102 sequentially extracts MIDI messages from the performance data having the oldest performance date and time information, and sequentially sends the extracted MIDI messages to the music generation unit 104.

When sending the MIDI messages to the music generation unit 104, the MIDI messages are sent to the music generation unit 104 based on the performance date and time information that is included in the performance data. For example, in the case of performance data of a note-ON message having performance date and time information "2009-08-31T13:05:05", and performance data of a note-OFF message having performance date and time information "2009-08-31T13:05:06", the note-OFF message is one second after the note-ON message, so the control unit 102 sends the note-OFF MIDI message to the music generation unit 104 one second after sending the note-ON MIDI message.

After a MIDI message has been supplied, the music generation unit 104 generates a music signal that corresponds to the note number and velocity that are specified in the MIDI message, and supplies the generated signal to the speaker 105. When the signal supplied from the music generation unit 104 is inputted to the speaker 105, music sound is outputted from the speaker 105 according to the input signal.

In this way, with this embodiment, data for reproducing a performance that was performed on the musical instrument terminal 1A is acquired by the other musical instrument terminal 1B, making it possible to reproduce and listen to a performance that was performed by another performer. Moreover, with this embodiment, for performance data that is stored in the server device 2, it is possible to obtain information of when and by what musical instrument terminal a performance was played for each performance file that includes performance data, and to search for a performance file.

In the explanation above, the musical instrument terminal 1B acquired a performance file from the server device 2, however the musical instrument terminal 1A can also acquire a performance file from the server device 2. In that case, the user of the musical instrument terminal 1A can acquire a performance file of a music performance played by the user, and listen to a past performance.

[Variation]

An embodiment of the present invention was explained above, however, the present invention is not limited to the embodiment described above, and other various embodiments are possible. For example, the present invention can be embodied by changing the embodiment above as described below. Various combinations of the embodiment and variation below are also possible.

In this invention, the name of a performer of the musical instrument terminal 1 can be stored in the storage unit 103 by the user operating the operation unit 106 as information for identifying the performer. Moreover, the musical instrument terminal 1 can send performance data that includes the name of the performer stored in the storage unit 103 to the server device 2, and the server device 2 can store all of the performance data that includes the names of performers as a performance file. The server device 2 can also store the name of a performer that is included in the performance data in a performance table. Furthermore, when the musical instrument device 1 acquires the performance table from the server device 2 and displays the contents of the performance table, it is also possible to display the names of the performer that are stored in the performance table.

In this invention, it is possible for the user to operate the operation unit 106 and store an image such as the photo of the performer of the musical instrument terminal 1 in the storage unit 103. The musical instrument terminal 1 can send performance data that includes the image of the performer that is stored in the storage unit 103 to the server device 2, and the server device 2 can store all of the performance data that includes images of the performers as a performance file. Moreover, the server device 2 can also store the images of performers that are included in the performance data in a performance table. Furthermore, when the musical instrument terminal 1 acquires the performance table from the server device 2 and displays the contents of the performance table, it is possible to also display the images of the performers that are stored in the performance table. In addition, not only is it possible to send a still image such as a photo, it is also possible to send moving image data of the user's performance and the area surrounding the performance to the server device 2, and store that moving image data together with the performance file.

The musical instrument terminal 1 can also store voice data that expresses the voice of the performer instead of an image such as a photo of the performer, and send performance data that includes the voice data that is stored in the storage unit 103 to the server device 2, and the server device 2 can store all of the voice data and performance data as a performance file. The server device 2 can also store voice data that is included in performance data in a performance table. Furthermore, when the musical instrument terminal 1 acquires the performance table from the server device 2 and displays the contents of the performance table, it is possible to reproduce the voice data that corresponds to the file identifier that is selected by the user.

In the embodiments described above, the performance date and time information has seconds information, however it is also possible to include values that are fractions of seconds or less.

In the present invention, when displaying the contents of the performance table, the displayed contents can be rearranged according to the length of time of the performance, the name of the performer and the like.

In the embodiments described above, the musical instrument terminal 1 is an electronic keyboard, however the musical instrument terminal 1 is not limited to an electronic keyboard, and can be a piano having an auto performance function. The musical instrument terminal 1 is also not limited to an instrument having a keyboard, and can be another kind of instrument as long as it can generate and process MIDI messages.

Moreover, in this invention, the server device 2 can analyze a MIDI message and performance date and time information in a performance file, specify a musical piece that the performance file expresses, and store information that indicates the title or name of the specified musical piece in a performance table. In addition, the server device 2 can acquire information such as the tempo and pitch of the performance from the MIDI message and performance date and time information, analyze the atmosphere and effects of a performance from the acquired information, and store the analyzed results in the performance table as musical attribute. With this kind of construction, a performance file can be selected and listened to by searching performance files according to their musical attributes such as effects and desired atmosphere. The effects and atmosphere (or mood) of a performance can be expressed by characteristic numerical amounts, and these characteristic amounts can be stored in the performance table. When searching for a performance file, these characteristic amounts can be input using the musical instrument terminal 1 and the performance files are searched with the input characteristic amount as keys, and a list of performance files that are obtained from this search can be displayed on the musical instrument terminal 1.

As described above, the table generation unit analyzes the sequence of the performance data contained in the performance file so as to determine a title of a piece of music represented by the sequence of the performance data or so as to obtain a musical attribute of a piece of music represented by the sequence of the performance data, and adds the determined title or obtained musical attribute into the performance table.

In the embodiments described above, MIDI messages are used as information for indicating a performance operation, however the format of information for indicating a performance operation is not limited to MIDI format, and could be some other format.

In the embodiments described above, the performance data includes a MIDI message, which is performance information, or instead of a MIDI message may include digital data as performance information that expresses the waveform of the music that is output by a performance operation. In the case of this construction, after the musical instrument terminal 1 acquires a performance file from the server device 2, the musical instrument terminal 1 converts the digital data that expresses the waveform of the music sound to an analog music signal, and supplies the music signal to the speaker 105.

In the embodiments described above, the musical terminal 1 performs communication with a server device 2 that is connected to a communication network 3, however, it is also possible to connect a personal computer (hereafter, referred to as a PC) to the musical instrument terminal 1, and for the PC that is connected to the communication network 3 to relay communication between the musical instrument terminal 1 and the server device 2.

More specifically, a program is stored in the PC that makes possible a function of performing communication with the musical instrument terminal 1 and a function of performing communication with the server device 2, where the PC executes this program. The musical instrument terminal 1 and PC are connected by a communication cable, and the musical instrument terminal 1 outputs performance data to the PC. After performance data is inputted, the PC sends the inputted performance data to the server device 2 via the communication network 3.

Moreover, when downloading a performance file that is stored in the server device 2 to the musical instrument terminal 1, first, the PC performs an operation to acquire a list of performance files that are stored in the server device 2. When performing this operation, the PC sends a request message to the server device 2 requesting a list of performance files. After receiving a performance table that is sent from the server device 2, the PC displays the contents of the performance table on a display unit. When the PC performs an operation requesting a performance file, the PC sends a file request message to the server device 2 requesting a performance file. After the performance file has been downloaded from the server device 2 to the PC, the PC sends the sent performance file to the musical instrument terminal 1. The musical instrument terminal 1 reproduces a performance as was done in the embodiment described above according to the performance data that is included in the performance file that was sent from the PC. With this variation, in the case where the musical instrument terminal 1 has an interface that performs input and output of performance data, there is no need for the musical instrument terminal 1 to have a function for performing communication using a communication network, so the construction of the musical instrument terminal 1 can be simplified.

In construction where a PC relays performance data between a musical instrument terminal 1 and server device 2, it is also possible to connect a portable terminal such as a PDA (Personal Digital Assistant) or mobile telephone to the communication network 3, and to acquire a list of performance files from the server device 2 using the portable terminal.

In addition, it is possible to perform an operation to select a performance file using a portable terminal, and send an instruction from the portable terminal to the PC to acquire the selected performance file, then have the PC acquire the selected performance file from the server device 2 and send the file to the musical instrument terminal 1.

Moreover, in the case of construction in which the musical instrument terminal 1 does not comprise a display unit 107, the portable terminal can acquire a list of performance files from the server device 2. The portable terminal can also be used to perform an operation of selecting a performance file and instructing the musical instrument terminal 1 to acquire the selected performance file, then the musical instrument terminal 1 can acquire the selected performance file from the server device 2.

In the present invention, when the server device 2 is connected to a musical instrument terminal 1A and musical instrument terminal 1B, performance data that is sequentially uploaded from the musical instrument terminal 1A can be downloaded to the musical instrument terminal 1B in the sent order. With this construction, even though the musical instrument terminal 1A and musical instrument terminal 1B are in separate locations, a performance that is played using musical instrument terminal 1A can be replayed by musical instrument terminal 1B.

In the present invention, the musical instrument terminal 1 can sequentially store performance data in the storage unit 103 that was generated by operating the performance unit 109. In addition, in the construction for storing performance data in the storage unit 103, when a note-ON MIDI message is not generated within a set amount of time after performance data that includes a note-OFF MIDI message is generated, the performance is determined to be finished, and the performance data that is stored in the storage unit 103 can be collected as one performance file and sent to the server device 2.

The server device 2 adds a file identifier to the performance file that was sent from the musical instrument terminal 1 and stores the performance file in the permanent memory area; and the file identifier, terminal identifier that is acquired from the performance file, the performance start date and time and the performance end date and time can also be correlated and stored in a performance table.

In the embodiments described above, when new performance data is not received within a set duration of time from when performance data is received, the performance data that is temporarily stored in the memory area is collected together to generate a performance file, however, the construction for generating a performance file is not limited to this construction. For example, the server device 2 sequentially stores performance data that is sent from the musical instrument terminal 1. Here, the case is presumed in which there is performance data No. 1 to No. 10 as performance data that is stored in order, where for the performance data No. 1 to No. 4, and the performance data No. 5 to No. 10, the time difference in the date and time that is indicated by the performance date and time information that is included in the data is less than 5 seconds between adjacent performance data except between the performance data No. 4 and No. 5, and the time difference between the date and time that is indicated by the performance date and time information that is included in performance data No. 4 and the date and time that is indicated by the performance date and time information that is included in performance data No. 5 is 5 seconds or more.

In this case, the server device 2 acquires the date and time that is indicated by the stored performance date and time information, and can divide out the stored performance data No. 1 to No. 4 as a performance file that expresses one performance, and can divide out stored performance data No. 5 to No. 10 as another performance file that expresses a next performance.

Moreover, after sequentially receiving performance data from the musical instrument terminal 1, the server device 2 can store the reception date and time of the performance data together with each performance data in the temporary memory area.

Here, the case is presumed in which there is performance data No. 1 to No. 10 that is stored in order, where for the date and time that is stored as a set with the performance data for the performance data No. 1 to No. 4, and the performance data No. 5 to No. 10, the time difference is less than 5 seconds between adjacent performance data except for the performance data No. 4 and No. 5, and the time difference between the date and time that is stored as a set with performance data No. 4 and the date and time that is stored as a set with performance data No. 5 is 5 seconds or more. In this case, the server device 2 can divide out the stored performance data No. 1 to No. 4 as a performance file that expresses one performance, and can divide out stored performance data No. 5 to No. 10 as a performance file that expresses performance that is different than the previous performance.

In the present invention, when sending a performance file to the musical instrument terminal 1, it is possible to generate a performance file from which the terminal identifier that is included in the performance data has been deleted, and send that file to the musical instrument terminal 1.

In the above described embodiments, the generated performance data is sent to the server device 2 every time the MIDI message is created. However, the present invention is not limited to such a configuration. For example, the musical instrument terminal 1 sequentially stores the generated performance data in the storage unit 103, and the stored performance data are transmitted to the server device 2 each time a predetermined time length elapses. In detail, upon start of musical performance, the musical instrument terminal 1 successively stores the generated performance data in the storage unit 103, and periodically transmits a group of the stored performance data each time predetermined n seconds pass where n seconds are set to, for example, five seconds at the design of the musical instrument. The musical instrument terminal 1 may delete the performance data stored in the storage unit 103 after the stored performance data have been sent to the server device 2. When another n seconds have passed after the previous performance data were transmitted, the musical instrument terminal 1 transmits a next group of the performance data which are stored in the storage unit 103 after the previous performance data have been transmitted. Hereafter, the musical instrument terminal 1 periodically sends a group of or packet of the performance data accumulated in the storage unit 103 every time the predetermined n seconds lapse. This configuration can reduce a number of sessions of communication between the musical instrument terminal 1 and the server device 2 as compared to a configuration where each performance data is successively sent to the server device 2 every time the performance data is generated.

Alternatively, the following configuration may be adopted in the construction where the performance data is not successively transmitted to the server device 2 every time the MIDI message is generated. Namely, the musical instrument terminal 1 sequentially accumulates the generated performance data in the storage unit 103, and then transmits the performance data accumulated in the storage unit 103 each time the total amount of the performance data stored in the storage unit 103 exceeds a predetermined amount. In detail, upon start of musical performance, the musical instrument terminal 1 stores the performance data in the storage unit 103, and then sends the performance data stored in the storage unit 103 to the server device 2 when the total amount of the performance data accumulated in the storage unit 103 reaches predetermined n bytes or more (n is predetermined at the designing of the musical instrument). The musical instrument terminal 1 may clear the performance data accumulated in the storage unit 103 after the accumulated performance data have been transmitted to the server device 2. Then, the musical instrument terminal 1 monitors an amount of performance data newly stored in the storage unit 103 after the previous performance data have been transmitted. When the total amount of the performance data newly stored in the storage unit 103 after the previous performance data have been sent out reaches at least n bytes, the musical instrument terminal 1 transmits the performance data stored in the storage unit 103. Hereafter, the musical instrument terminal 1 transmits the performance data stored in the storage unit 103 each time the total amount of the performance data stored in the storage unit 103 exceeds the predetermined n bytes. This configuration can reduce a number of sessions of communication between the musical instrument terminal 1 and the server device 2 as compared to a configuration where each performance data is successively sent to the server device 2 every time the performance data is generated.

In an expedient form, the configuration where the performance data stored in the storage unit 103 is transmitted to the server device 2 every time the predetermined time passes and the configuration where the performance data are sent to the sever device 2 every time the total amount of the performance data stored in the storage unit 103 exceeds the predetermined data amount are combined with each other.

In the above described embodiments, the server device 2 extracts the performance data stored in the buffer area using the terminal identifier as a search key, and then the extracted performance data is packed into one file and generated as the performance file. There are various ways for formulating the performance file by collecting the performance data specified according to the terminal identifier. For example, the server device 2 divides or separates the plurality of the received performance data by the acquisition date and time of the performance data which has been lastly received from the musical instrument terminal 1, then extracts the performance data containing a particular target terminal identifier from the RAM among the plurality of the separated performance data which precede the last performance data received by the server device 2, and stores the extracted performance data in the storage unit 203.

Next, the server device 2 sequentially extracts performance data from the storage unit 203 in the order of older ones having older performance date and time to newer performance data having newer performance data, then specifies addresses of memory areas at which the extracted performance data are stored, and records the specified addresses in the order of the performance date and time as log information of the musical performance. According to this configuration, the performance data are sequentially read out from the storage unit 203 in the order of performance date and time based on the addresses contained in the log information, and the musical performance is played back by reproducing the read performance data.

Alternatively, the server device 2 extracts the performance date and time information contained in the performance data stored in storage unit 203, and records the extracted performance date and time information sequentially from early ones to late ones as log information.

Alternatively, when the performance data extracted from the RAM are stored in the storage unit 203, the server device 2 stores the extracted performance data in the order of the performance date and time indicated by the performance date and time information contained in the extracted performance data as log information of the musical performance. In this case, at the time of recording the extracted performance data as the log information, since the sequence of the performance data is specified from the performance time and date information contained in the performance data, it is not necessary to store the performance data in the storage unit 203 in the order of the performance date and time indicated by the performance data and time information contained in the performance data.

The invention claimed is:

1. A storage system comprising: a plurality of musical instruments capable of sending information; and a storage device capable of communicating with the plurality of the musical instruments and storing information sent from the musical instruments, wherein the musical instrument comprises:

a performance information generation unit that generates performance information of the musical instrument;

a first clock unit that measures date and time; and a transmission unit that sends performance data to the storage device when the performance information is generated by the performance information generation unit, the performance data being a set of the performance information generated by the performance information generation unit and performance date and time information that indicates performance date and time measured by the first clock unit when the performance information is generated by the performance information generation unit, and wherein the storage device comprises:

a receiving unit that receives the performance data sent from the transmission unit of the musical instrument;

a second clock unit that measures date and time;

a storage unit that stores the performance data received by the receiving unit; and a file generation unit that divides a plurality of the performance data stored in the storage unit into blocks based on the performance date and time information included in the performance data received by the receiving unit, or based on acquisition date and time of the performance data measured by the second clock unit when the performance data is received by the receiving unit, and that generates performance files corresponding to the blocks of the performance data.

2. The storage system according to claim 1, wherein the file generation unit divides the plurality of the performance data into blocks when a time interval on the time line of the performance date and time of the performance date and time information that is included in the plurality of the performance data received by the receiving unit is a specified value or greater, or when a time interval on the time line of the acquisition date and time at which the plurality of the performance data are received by the receiving unit is a specified value or greater.

3. The storage system according to claim 1, wherein the receiving unit receives the performance data containing a terminal identifier identifying the musical instrument that transmits the performance data, the storage unit stores the performance data received by the receiving unit together with the terminal identifier identifying the musical instrument that transmits the performance data and the acquisition date and time of the performance data measured by the second clock unit when the performance data is received by the receiving unit, and the file generation unit divides the plurality of the performance data stored in the storage unit into blocks based on the terminal identifier such that each block contains the performance data sent by the same musical instrument, and based on the acquisition date and time of the performance data measured by the second clock unit, when a difference between a current date and time measured by the second clock unit and a recent one of the acquisition time and date of the performance data is greater than a predetermined time length.

4. The storage system according to claim 3, wherein the file generation unit generates the performance file containing log information which records addresses of the performance data at which the performance data of the corresponding block are stored in the storage unit, sequentially in the order of each performance date and time contained in each performance data.

5. The storage system according to claim 3, wherein the file generation unit generates the performance file containing log information which records each performance date and time contained in each performance data of the corresponding block, sequentially from early performance date and time to late performance date and time.

6. The storage system according to claim 1, wherein the transmission unit successively accumulates the performance data, and transmits the accumulated performance data when a predetermined time length lapses from a time at which previously accumulated performance data have been transmitted to the storage device.

7. The storage system according to claim 1, wherein the transmission unit successively accumulates the performance data, and transmits the accumulated performance data each time a total amount of the accumulated performance data exceeds a predetermined amount.

8. The storage system according to claim 1, wherein the storage device further comprises a table generation unit that generates a performance table of the performance files generated by the file generation unit, such that the performance table contains a file identifier identifying a performance file generated by the file generation unit, a terminal identifier identifying the musical instrument that transmits a plurality of performance data contained in the performance file or a user identifier identifying a user of the musical instrument that transmits a plurality of performance data contained in the performance file, a start date and time indicting a start date and time at which a plurality of performance data of the performance file starts, and an end date and time indicting an end date and time at which a plurality of performance data of the performance file ends.

9. The storage system according to claim 8, wherein the musical instrument further comprises:

a table acquiring unit that acquires the performance table from the storage device;

a display unit that displays the performance table for selection of a desired performance file listed in the performance table; and a requesting unit that requests downloading of the selected performance file from the storage device for reproduction of the performance information contained in the selected performance file.

10. The storage system according to claim 8, wherein the table generation unit analyzes the plurality of the performance data contained in the performance file so as to determine a title of a piece of music represented by the plurality of the performance data or so as to obtain a musical attribute of a piece of music represented by the plurality of the performance data, and adds the determined title or obtained musical attribute into the performance table.

11. The storage system according to claim 1, wherein the musical instrument is played by a user to perform pieces of music so that the performance information generation unit generates the performance information during the course of performing the pieces of music and the transmission unit sends the plurality of the performance data in response to the generation of the performance information, and wherein the file generation unit of the storage device divides the plurality of the performance data into blocks respectively corresponding to the pieces of music and respectively corresponding to the performance files, each performance file containing performance data for reproducing the corresponding piece of music.

12. The storage system according to claim 11, wherein the file generation unit of the storage device divides the plurality of the performance data between a performance data belonging to a preceding piece of music and another performance data belonging to a succeeding piece of music.

13. A storage device that communicates with a musical instrument having a performance information generation unit for generating performance information, a first clock unit for measuring date and time, and a transmission unit for sending a plurality of performance data, which is a set of the performance information generated by the performance information generation unit and performance date and time information that indicates performance date and time that is measured by the first clock unit when the performance information is generated by the performance information generation unit, the storage device comprising:

a receiving unit that receives the performance data sent from the transmission unit of the musical instrument;

a second clock unit that measures date and time;

a storage unit that stores the performance data received by the receiving unit; and a file generation unit that divides a plurality of the performance data stored in the storage unit into blocks based on the performance date and time information included in the performance data received by the receiving unit, or based on acquisition date and time of the performance data measured by the second clock unit when the performance data is received by the receiving unit, and that generates performance files corresponding to the blocks of the performance data.

* * * * *